US010043437B2

(12) United States Patent
Kang

(10) Patent No.: US 10,043,437 B2
(45) Date of Patent: Aug. 7, 2018

(54) DISPLAY DEVICE AND METHOD FOR DRIVING BACKLIGHT THEREOF

(71) Applicant: SAMSUNG ELECTRONICS CO., LTD., Suwon-si, Gyeonggi-do (KR)

(72) Inventor: Jeong-il Kang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 130 days.

(21) Appl. No.: 14/936,001

(22) Filed: Nov. 9, 2015

(65) Prior Publication Data

US 2016/0232832 A1 Aug. 11, 2016

(30) Foreign Application Priority Data

Feb. 10, 2015 (KR) ..... 10-2015-0019996

(51) Int. Cl.
*G09G 3/20* (2006.01)
*G09G 3/34* (2006.01)

(52) U.S. Cl.
CPC ..... *G09G 3/2014* (2013.01); *G09G 3/2081* (2013.01); *G09G 3/3406* (2013.01); *G09G 2320/0271* (2013.01); *G09G 2320/064* (2013.01); *G09G 2330/02* (2013.01)

(58) Field of Classification Search
None
See application file for complete search history.

(56) References Cited

U.S. PATENT DOCUMENTS 7,079,092 B2 * 7/2006 Tanghe ..... G09G 3/3216 315/169.3
8,299,987 B2 * 10/2012 Neudorf ..... H05B 33/0818 315/169.3
8,581,565 B2 * 11/2013 Tang ..... H02M 3/335 323/238
2008/0007241 A1 * 1/2008 Isham ..... H02M 1/08 323/285
2008/0080577 A1 * 4/2008 Nguyen ..... H04B 10/40 372/38.02
2009/0096724 A1 * 4/2009 Ichikawa ..... H05B 33/0869 345/82
2009/0108768 A1 * 4/2009 Yang ..... H05B 33/0818 315/291
2011/0012937 A1 * 1/2011 Onishi ..... G09G 3/3426 345/690

(Continued)

*Primary Examiner* — Patrick Moon
*Assistant Examiner* — Peijie Shen
(74) *Attorney, Agent, or Firm* — Staas & Halsey LLP

(57) ABSTRACT

A display device and a method for driving a backlight thereof are provided. The display device includes a signal generator configured to generate a first PWM (Pulse Width Modulation) signal and a second PWM signal, a low current driver configured to generate first output current using the first PWM signal, a high current driver configured to generate second output current using the second PWM signal, and a backlight configured to be driven by at least one of the first output current generated by the low current driver and the second output current generated by the high current driver. Accordingly, the display device can control the brightness of the backlight with an extended resolution which is higher than the resolution that can be output from the existing backlight.

8 Claims, 6 Drawing Sheets

(56) References Cited

U.S. PATENT DOCUMENTS

| | | | | |
|---|---|---|---|---|
| 2012/0319615 | A1* | 12/2012 | Lee | H05B 33/0818 315/289 |
| 2013/0293140 | A1* | 11/2013 | Bohm | H05B 33/0815 315/250 |
| 2016/0113085 | A1* | 4/2016 | Vaananen | H05B 33/0851 315/185 R |
| 2016/0117997 | A1* | 4/2016 | Matsui | H05B 33/0845 345/691 |
| 2016/0125791 | A1* | 5/2016 | Park | G09G 3/2096 345/211 |
| 2017/0110062 | A1* | 4/2017 | Zhang | G09G 3/342 |

* cited by examiner

DISPLAY DEVICE AND METHOD FOR DRIVING BACKLIGHT THEREOF

PRIORITY

This application claims priority under 35 U.S.C. § 119(a) to Korean Patent Application No. 10-2015-0019996, filed on Feb. 10, 2015, in the Korean Intellectual Property Office, the disclosure of which is incorporated herein by reference.

BACKGROUND

1. Field

The present disclosure relates to a display device and a method for driving a backlight thereof, and more particularly to a display device and a method for driving a backlight thereof, which can drive a backlight with high resolution.

2. Description of the Related Art

In general, a display device controls the brightness of a backlight using a PWMO signal. That is, the display device can control the brightness of the backlight by turning on/off light emitting diodes that constitute the backlight through applying of constant current to the backlight at a time when a PWM (Pulse Width Modulation) signal is applied.

On the other hand, in order to meet user's need for higher picture quality, a method for extending resolution of a backlight has been studied. In relation to this, a method for extending resolution of a backlight in the related art extends a low grayscale section in which a difference between brightness changes of the backlight can be easily discriminated in vision. The method for extending resolution with respect to the low grayscale section as described above may divide the low grayscale section, which has a dark brightness, among the entire section at predetermined intervals, and apply current corresponding to PWM signals to the backlight for respective divided sections.

In the case of the above-described method in the related art, however, the widths of the PWM signals for the respective divided sections in the low grayscale section are too short, and thus the current applied to the backlight is unable to sufficiently rise over a predetermined level, but falls. Accordingly, the brightness of the backlight in the corresponding section may become dark, and linearity of the brightness of the backlight may be deteriorated.

SUMMARY

The present disclosure has been made to address at least the above needs and to provide at least the advantages described below, and an aspect of the present disclosure provides extension of resolution of a backlight so that the backlight is driven to output light with various brightness levels.

According to one aspect of the present disclosure, a display device includes a signal generator configured to generate a first PWM signal and a second PWM signal; a low current driver configured to generate first output current using the first PWM signal; a high current driver configured to generate second output current using the second PWM signal; and a backlight configured to be driven by at least one of the first output current generated by the low current driver and the second output current generated by the high current driver.

Current (amperes) per unit of time of the first output current may be lower than current per unit of time of the second output current.

A sum of current per unit of time of the first output current and current per unit of time of the second output current may be a maximum allowable current of the backlight.

The low current driver and the high current driver may be connected in parallel to each other.

In the case of outputting an image having a brightness that is equal to or lower than a predetermined brightness, the backlight may be driven using only the first output current generated by the low current driver.

Current per unit of time of the second output current generated by the high current driver may have a size of (or amount) a multiple that is predetermined on the basis of current per unit of time of the first output current generated by the low current driver.

According to another aspect of the present disclosure, a method for driving a backlight of a display device includes generating a first PWM signal and a second PWM signal; generating first output current from the first PWM signal using a low current driver, and generating second output current from the second PWM signal using a high current driver; and driving a backlight using at least one of the first output current and the second output current.

Current per unit of time of the first output current may be lower than current per unit of time of the second output current.

A sum of current per unit of time of the first output current and current per unit of time of the second output current may be a maximum allowable current.

The low current driver and the high current driver may be connected in parallel to each other.

The driving may include driving the backlight using only the first output current in the case of outputting an image having a brightness that is equal to or lower than a predetermined brightness.

Current per unit of time of the second output current generated by the high current driver may have a size of a multiple that is predetermined on the basis of current per unit of time of the first output current generated by the low current driver.

According to one aspect of the present disclosure, a display device includes a signal generator configured to generate a first PWM (Pulse Width Modulation) signal and a second PWM signal, a first current driver configured to generate a first output current using the first PWM signal, a second current driver configured to generate a second output current using the second PWM signal, and a backlight configured to be driven by at least one of the first output current generated by the low current driver and the second output current generated by the high current driver where the first output current is lower than the second output current.

According to one aspect of the present disclosure, a display device method includes generating a first PWM (Pulse Width Modulation) signal and a second PWM signal, generating first output current from the first PWM signal using a first current driver, and generating second output current from the second PWM signal using a second current driver, and driving a backlight using at least one of the first output current and the second output current where the first output current is lower than the second output current.

As described above, according to the present disclosure, the display device can control the brightness of the backlight with the extended resolution which is higher than the resolution that can be output from the existing backlight.

BRIEF DESCRIPTION OF THE DRAWINGS

The above and other aspects, features and advantages of the present disclosure will be more apparent from the following detailed description when taken in conjunction with the accompanying drawings, in which.

DETAILED DESCRIPTION OF EMBODIMENTS

Figure 1:
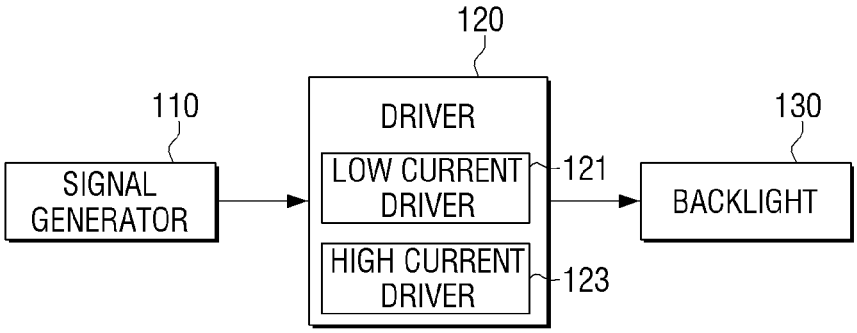
FIG. 1 is a block diagram of a display device according to an embodiment of the present disclosure.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail since they would obscure the disclosure with unnecessary detail.

The terms "first", "second", etc. may be used to describe diverse components, but the components are not limited by the terms. The terms are only used to distinguish one component from the others.

Hereinafter, preferred embodiments of the present disclosure will be described in detail with reference to the accompanying drawings.

FIG. 1 is a block diagram of a display device according to an embodiment of the present disclosure.

As illustrated in FIG. 1, a display device includes a signal generator 110, a driver 120, and a backlight 130.

The signal generator 110 generates PWM (Pulse Width Modulation) signals for controlling on/off operation of driving current that is applied to a plurality of light emitting diodes constituting the backlight 130. Specifically, the signal generator 110 generates a first PWM signal for controlling on/off operation of low current and a second PWM signal for controlling on/off operation of high current, which are applied to the plurality of light emitting diodes that constitute the backlight 130.

The driver 120 generates output current for applying a power to the plurality of light emitting diodes that constitute the backlight 130 based on the PWM signals generated by the signal generator 110. The driver 120 may include a low current driver 121 and a high current driver 123.

The low current driver 121 generates first output current that corresponds to the low current using the first PWM signal generated by the signal generator 110. Further, the high current driver 123 generates second output current that corresponds to the high current using the second PWM signal generated by the signal generator 110.

The backlight 130 is driven by at least one of the first output current generated through the low current driver 121 and the second output current generated through the high current driver 123. Accordingly, the backlight 130 may control the light emission and brightness of the plurality of light emitting diodes that constitute the backlight 130 based on the output current that is applied from at least one of the low current driver 121 and the high current driver 123.

The backlight 130 may be configured, for example, as a direct type in which the plurality of light emitting diodes are arranged at the whole lower end of a display panel (not illustrated) or as an edge type in which the plurality of light emitting diodes are arranged at the edges of the display panel (not illustrated). Further, the plurality of light emitting diodes that constitute the backlight 130 may be connected in series or in parallel to one another, and may be simultaneously turned on/off or may be dividedly driven in a unit of a block by at least one of the first output current and the second output current applied to the backlight 130.

On the other hand, it is preferable that current per unit of time of the first output current that is generated through the low current driver 121 is lower than current per unit of time of the second output current that is generated through the high current driver 123. Further, the sum of the current per unit of time of the first output current that is generated through the low current driver 121 and the current per unit of time of the second output current that is generated through the high current driver 123 may be the maximum allowable current of the backlight 130. In this case, the current per unit of time of the second output current generated by the high current driver 123 may have a size of a multiple that is predetermined on the basis of the current per unit of time of the first output current generated by the low current driver 121.

For example, if the maximum current per unit of time that drives the backlight 130 is 1 A, the current per unit of time of the first output current generated through the low current driver 121 may be 0.2 A, and the current per unit of time of the second output current generated through the high current driver 123 may be 0.8 A.

Accordingly, the backlight 130 may output an image with various brightness levels based on at least one of the first output current generated through the low current driver 121 and the second output current generated through the high current driver 123. According to the embodiment, in the case of outputting an image with a brightness that is equal to or lower than a predetermined brightness, the backlight 130 may be driven using the first output current and the second output current respectively generated by the low current driver 121 and the high current driver 123.

Specifically, in the case of outputting an image with a brightness that is equal to or lower than the predetermined brightness, which corresponds to a low grayscale, the signal generator 110 generates only the first PWM signal. Accordingly, the low current driver 121 generates the first output current that is the low current using the first PWM signal. Accordingly, the backlight 130 may output an image having the brightness that is equal to or lower than the predetermined brightness by the first output current generated through the low current driver 121. On the other hand, in the case of outputting an image with a brightness that is equal to or higher than the predetermined brightness, the signal generator 110 generates the first PWM signal and the second PWM signal. Accordingly, the low current driver 121 may generate the first output current that is the low current using the first PWM signal, and the high current driver 123 may generate the second output current that is the high current using the second PWM signal. Accordingly, the backlight 130 may output an image having the brightness that is equal to or higher than the predetermined brightness using the first output current and the second output current that are respectively generated by the low current driver 121 and the high current driver 123.

On the other hand, the present disclosure is not limited thereto, and the driver 120 that generates the output current using the PWM signals may further include a middle current driver (not illustrated) that generates an output current between the low current and the high current in addition to the low current driver 121 and the high current driver 123 that generate the low output current and the high output current, respectively.

For example, if the maximum current per unit of time that drives the backlight 130 is 1 A, the current per unit of time of the first output current generated through the low current driver 121 may be 0.2 A, the current per unit of time of the second output current generated through the high current driver 123 may be 0.5 A, and the current per unit of time of the output current that corresponds to the middle current generated through the middle current driver (not illustrated) may be 0.3 A.

Figure 2A:
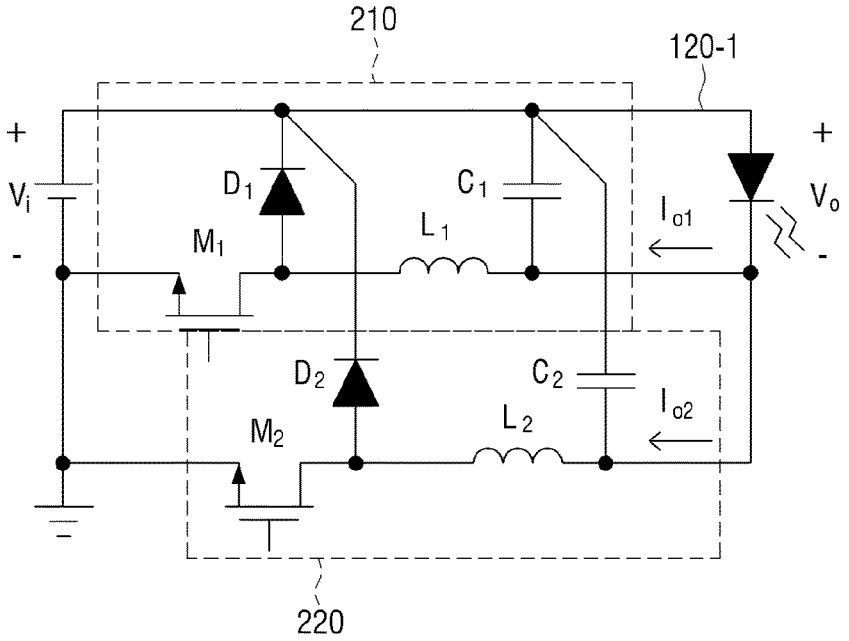
FIGS. 2A and 2B are circuit diagrams of a driver of a display device according to an embodiment of the present disclosure.
Figure 2B:
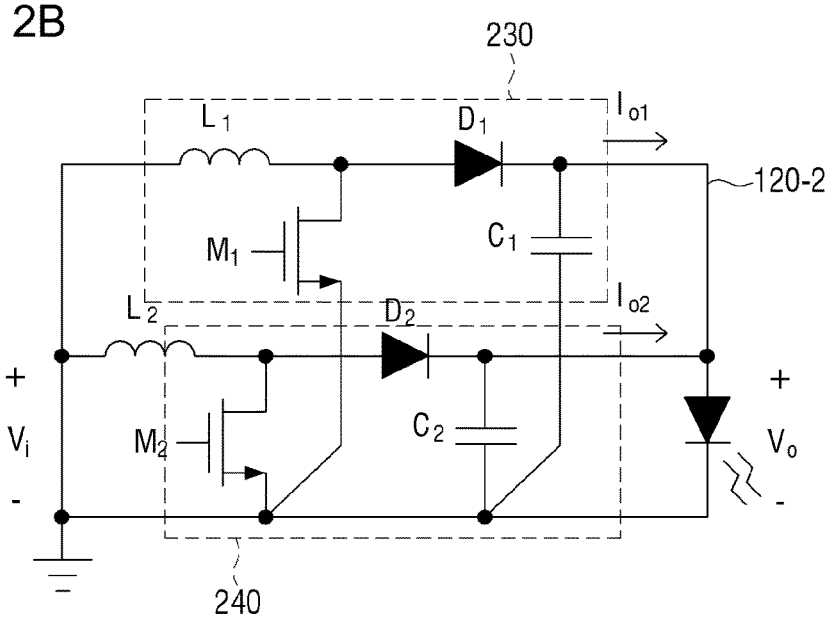

FIGS. 2A and 2B are circuit diagrams of a driver of a display device according to an embodiment of the present disclosure.

The driver 120 may be configured as circuits of FIGS. 2A and 2B. Specifically, the driver 120 may be implemented by a buck driving circuit 120-1 illustrated in FIG. 2A, or may be implemented by a boost driving circuit 120-2 illustrated in FIG. 2B. In general, the buck driving circuit 120-1 may be a circuit that outputs an output voltage that is lower than an input voltage, and the boost driving circuit 120-2 may be a circuit that outputs an output voltage that is higher than an input voltage. Since the driving methods of the buck driving circuit 120-1 and the boost driving circuit 120-2 are well known in the art, and thus the detailed explanation thereof will be omitted.

On the other hand, the buck driving circuit 120-1 and the boost driving circuit 120-2 include low current driving circuits 210 and 230 that generate the first output current that is the low current and high current driving circuits 220 and 240 that generate the second output current that is the high current. The low current driving circuits 210 and 230 and the high current driving circuits 220 and 240 that are respectively included in the buck driving circuit 120-1 and the boost driving circuit 120-2 are connected in parallel to each other. Each of the low current driving circuits 210 and 230 that are connected in parallel to the high current driving circuits 220 and 240 includes a first transistor M1 for generating the first output current that is low current, a first diode D1, a first inverter L1, and a first capacitor C1. Further, each of the high current driving circuits 220 and 240 that are connected in parallel to the low current driving circuits 210 and 230 includes a second transistor M2 for generating the second output current that is high current, a second diode D2, a second inductor L2, and a second capacitor C2.

The first and second transistors M1 and M2 of the low current driving circuits 210 and 230 and the high current driving circuits 220 and 240 are devices that perform on/off switching of the output current that is applied to the backlight. Specifically, if the first transistor M1 is turned on in accordance with the first PWM signal, an input voltage for the first PWM signal is applied to the first inductor L1 and the first capacitor C1 that are commonly connected to one end of the first transistor M1, and the low current driving circuit 210 included in the buck driving circuit 120-1 may apply the first output current that is low current corresponding to a difference between the applied input voltage and the output voltage for the input voltage to the backlight 130.

Further, if the first transistor M1 is turned on in accordance with the first PWM signal, an input voltage for the first PWM signal is applied to a node that is connected to one end of the first inductor L1 and one end of the first diode D1, and the low current driving circuit 210 included in the boost driving circuit 120-2 may apply the first output current that is low current corresponding to the output voltage according to the applied input voltage to the backlight 130.

On the other hand, if the second transistor M2 is turned on in accordance with the second PWM signal, an input voltage for the second PWM signal is applied to the second inductor L2 and the second capacitor C2 that are commonly connected to one end of the second transistor M2, and the high current driving circuit 220 included in the buck driving circuit 120-1 may apply the second output current that is high current corresponding to a difference between the applied input voltage and the output voltage for the input voltage to the backlight 130.

Further, if the second transistor M2 is turned on in accordance with the second PWM signal, an input voltage for the second PWM signal is applied to a node that is connected to one end of the second inductor L2 and one end of the second diode D2, and the high current driving circuit 220 included in the boost driving circuit 120-2 may apply the second output current that is high current corresponding to the output voltage according to the applied input voltage to the backlight 130.

Hereinafter, the operation of controlling dimming resolution of the backlight 130 by at least one of the first output current that is low current generated through the low current driver 121 and the second output current that is high current generated through the high current driver 123 will be described in detail.

Figure 3:
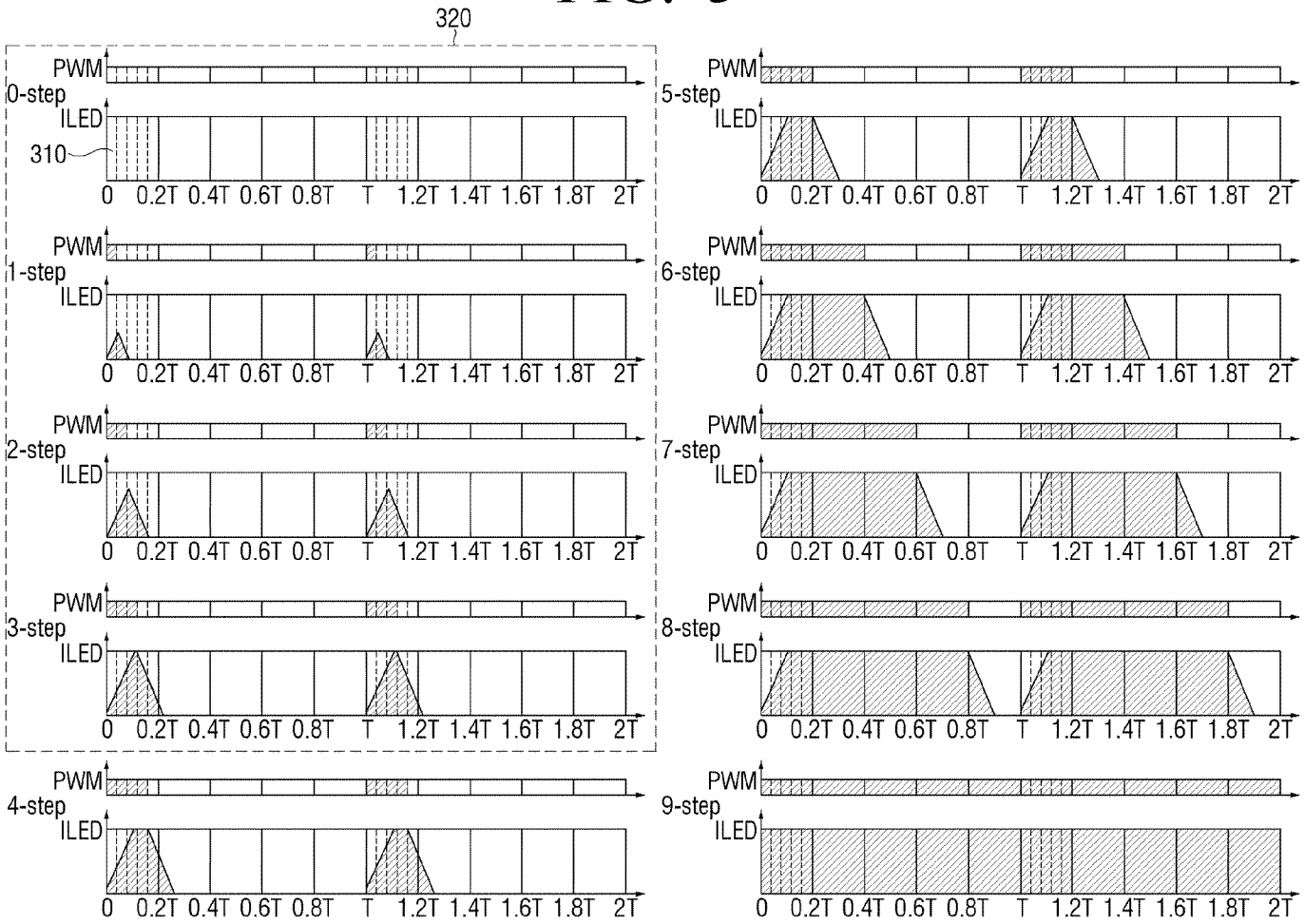
FIG. 3 is an exemplary diagram of PWM dimming waveforms for controlling dimming resolution in a general display device.

FIG. 3 is an exemplary diagram of PWM dimming waveforms for controlling dimming resolution in a general display device.

FIG. 3 illustrates 9-stage PWM dimming waveforms by low grayscale extension of PEM dimming resolution in a general display device.

In general, in the case of controlling the brightness of the plurality of light emitting diodes constituting the backlight 130 at a low grayscale having dark brightness, a difference between fine grayscales may be easily discriminated. Accordingly, as illustrated in FIG. 3, low grayscale extension may be implemented by dividing the low grayscale section 310 of the section for the PWM period at equal intervals and by implementing more detailed dimming with respect to the low grayscale section through performing of on/off control of current flowing to the light emitting diodes as long as the time corresponding to the respective detailed sections divided at equal intervals.

However, the current waveform of the light emitting diode generally requires a rising time and a falling time that are relatively long in comparison to the PWM signal. Due to such a cause, in the display device in the related art, the widths of the PWM signals are too short in a specific section 320 that belongs to 0 to 4-stage PWM dimming waveforms among 9-stage PWM dimming waveforms, and thus the current applied to the backlight is unable to sufficiently rise, but falls. Accordingly, the brightness of the light emitting diodes in the specific section 320 may become dark, and linearity of the brightness may be deteriorated.

Figure 4:
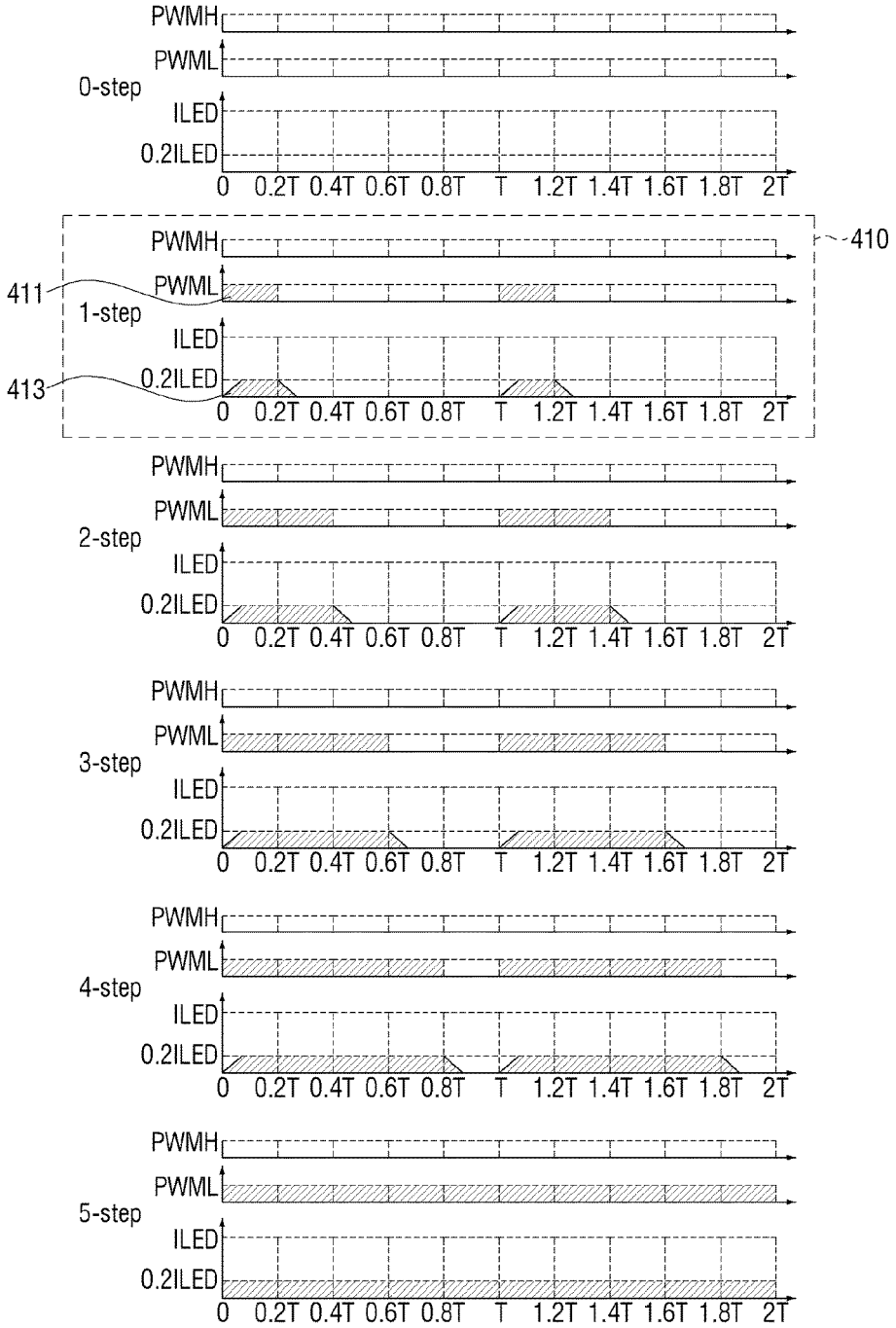
FIG. 4 is an exemplary diagram of PWM dimming waveforms for low grayscale extension of dimming resolution in a display device according to an embodiment of the present disclosure.

FIG. 4 is an exemplary diagram of PWM dimming waveforms for low grayscale extension of dimming resolution in a display device according to an embodiment of the present disclosure.

As described above, the display device according to the present disclosure may generate the first output current that is low current and the second output current that is high current using the first and second PWM signals generated through the signal generator 110. Accordingly, the display device according to the present disclosure may apply only the first output current that is low current to the backlight 130 for low grayscale extension of the dimming resolution.

As illustrated in FIG. 4, for the low grayscale extension, the display device applies the first PWM signal PWML (Pulse Width Modulation Low) for a unit of time per section set by PWM periods. Accordingly, the low current driver 121 may apply the first output current that is low current to the backlight 130 using the applied first PWM signal PWML. For example, in the case where the light emitting diodes emit light with a brightness of low grayscale corresponding to a first stage 410, the display device may apply the first PWM signal (PWML) 411 for a first unit of time (0 to 0.2 T). In this case, the low current driver 121 may apply current 413 of 0.2 A to the backlight 130 for the first unit of time (0.2 T) using the first PWM signal PWML. Accordingly, the light emitting diodes of the backlight 130 may emit light with a brightness of low grayscale corresponding to the first stage 410 by the current of 0.2 A that is applied for the first unit of time (0.2 T).

As another example, in the case where the light emitting diodes emit light with a brightness of low grayscale corresponding to a second stage, the display device may apply the first PWM signal PWML for a second unit of time (0 to 0.4 T). In this case, the low current driver 121 may apply current of 0.2 A to the backlight 130 for the second unit of time (0 to 0.4 T) using the first PWM signal PWML. Accordingly, the light emitting diodes of the backlight 130 may emit light with a brightness that is brighter than the brightness of low grayscale of the first stage.

As illustrated in FIG. 4, in the case where the light emitting diodes emit light with a brightness of low grayscale corresponding to a fifth stage in a state where 5 sections are set by PWM periods, the display device may apply the first PWM signal PWML for a fifth unit of time (0 to 1 T). In this case, the low current driver 121 may apply current of 0.2 A to the backlight 130 for the fifth unit of time (0 to 1 T). Accordingly, the light emitting diodes of the backlight 130 may emit light with the maximum brightness that can be emitted at low grayscale.

Figure 5:
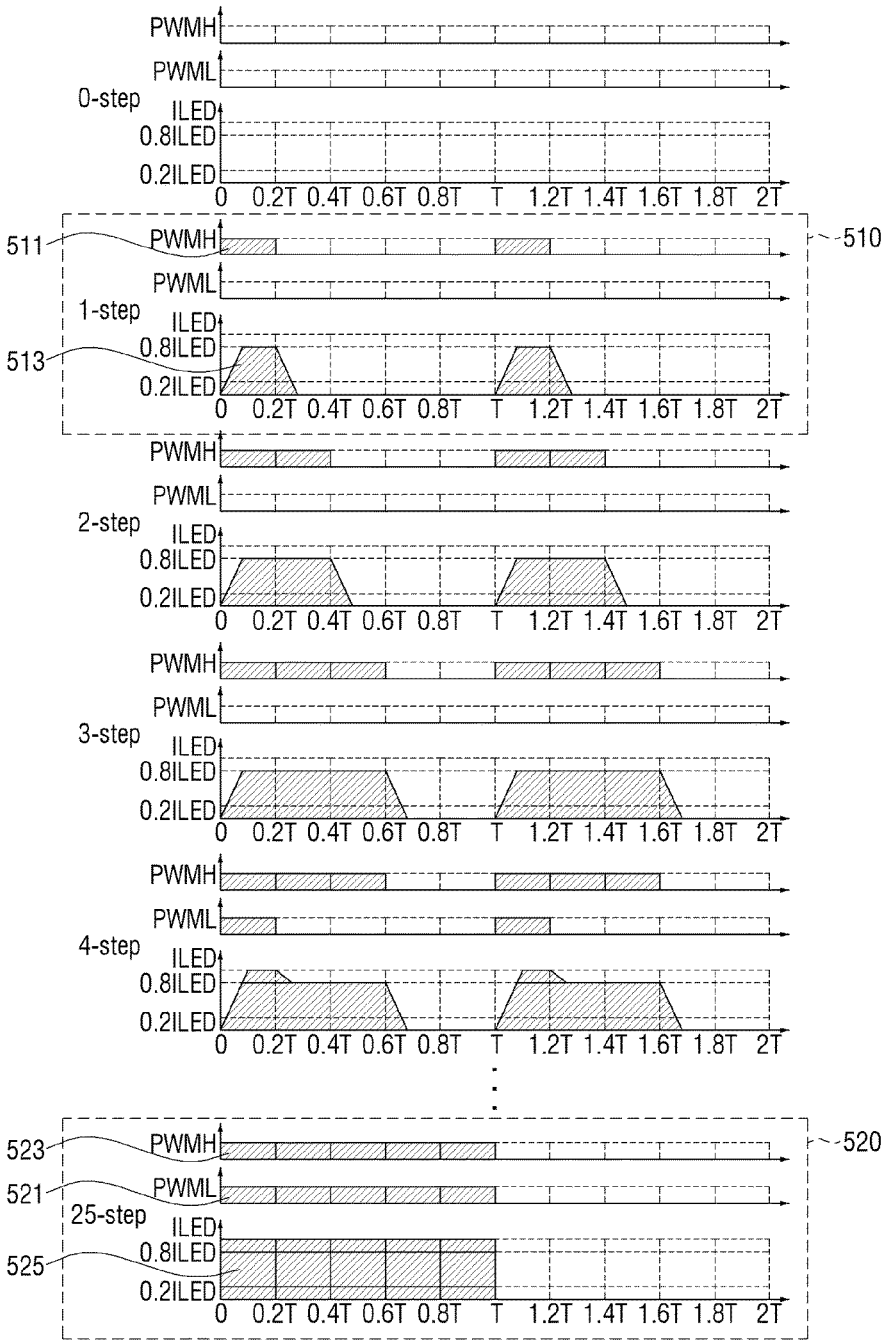
FIG. 5 is an exemplary diagram of PWM dimming waveforms for the whole grayscale extension of dimming resolution in a display device according to an embodiment of the present disclosure.

FIG. 5 is an exemplary diagram of PWM dimming waveforms for the whole grayscale extension of dimming resolution in a display device according to an embodiment of the present disclosure.

As described above, the display device according to the present disclosure may generate the first output current that is low current and the second output current that is high current using the first and second PWM signals generated through the signal generator 110. Accordingly, the display device according to the present disclosure may apply at least one of the first output current that is low current and the second output current that is high current to the backlight 130 for the whole grayscale extension of dimming resolution.

Since the low grayscale extension has been described in detail with reference to FIG. 4, the detailed explanation thereof will be omitted.

On the other hand, for the middle grayscale extension, the display device applies the second PWM signal PWMH (Pulse Width Modulation High) for a unit of time per section set by PWM periods. Accordingly, the high current driver 123 may apply the second output current that is high current to the backlight 130 using the applied second PWM signal PWMH. For example, in the case where the light emitting diodes emit light with a brightness of middle grayscale corresponding to a first stage 510, the display device may apply the second PWM signal (PWMH) 511 for a first unit of time (0 to 0.2 T). In this case, the high current driver 123 may apply current 513 of 0.8 A to the backlight 130 for the first unit of time (0 to 0.2 T) using the second PWM signal PWMH. Accordingly, the light emitting diodes of the backlight 130 may emit light with a brightness of middle grayscale corresponding to the first stage 510 by the current of 0.8 A that is applied for the first unit of time (0.2 T).

As another example, in the case where the light emitting diodes emit light with a brightness of middle grayscale corresponding to a second stage, the display device may apply the second PWM signal PWMH for a second unit of time (0 to 0.4 T). In this case, the high current driver 123 may apply current of 0.8 A to the backlight 130 for the second unit of time (0 to 0.4 T) using the second PWM signal PWMH. Accordingly, the light emitting diodes of the backlight 130 may emit light with a brightness that is brighter than the brightness of middle grayscale of the first stage.

On the other hand, for the high grayscale extension, the display device applies the first PWM signal PWML and the second PWM signal PWMH for a unit of time per section set by PWM periods. Accordingly, the low current driver 121 may generate and apply the first output current that is low current to the backlight 130 using the applied first PWM signal PWML, and the high current driver 123 may generate and apply the second output current that is high current to the backlight 130 using the applied second PWM signal PWMH.

For example, in the case where the light emitting diodes emit light with a brightness of high grayscale corresponding to a fourth stage, the display device may apply the first PWM signal PWML for a first unit of time (0 to 0.2 T) and apply the second PWM signal P"WMH for a third unit of time (0 to 0.6 T). In this case, the low current driver 121 may apply current of 0.2 A to the backlight 130 for the first unit of time (0 to 0.2 T) using the first PWM signal PWML, and apply current of 0.8 A to the backlight 130 for the third unit of time (0 to 0.6 T) using the second PWM signal PWMH.

Accordingly, the light emitting diodes of the backlight 130 may emit light with a brightness corresponding to 1 A for the first unit of time (0 to 0.2 T) among the third unit of time (0 to 0.6 T), and emit light with a brightness corresponding to 0.8 A for the remaining time.

As illustrated in FIG. 5, in the case where the light emitting diodes emit light with a brightness of high grayscale corresponding to a $25^{th}$ stage in a state where 5 sections are set by PWM periods, the display device may apply the first PWM signal PWML and the second PWM signal PWMH for a fifth unit of time (0 to 1 T). In this case, the low current driver 121 and the high current driver 123 may apply current of 0.2 A and current of 0.8 A to the backlight 130 for the fifth unit of time (0 to 1 T). Accordingly, the light emitting diodes of the backlight 130 may emit light with the maximum brightness that can be emitted at high grayscale.

Up to now, the operation for grayscale extension of the backlight in the display device according to various embodiments of the present disclosure has been described. Hereinafter, a method for driving a backlight in a display device according to the present disclosure will be described in detail.

Figure 6:
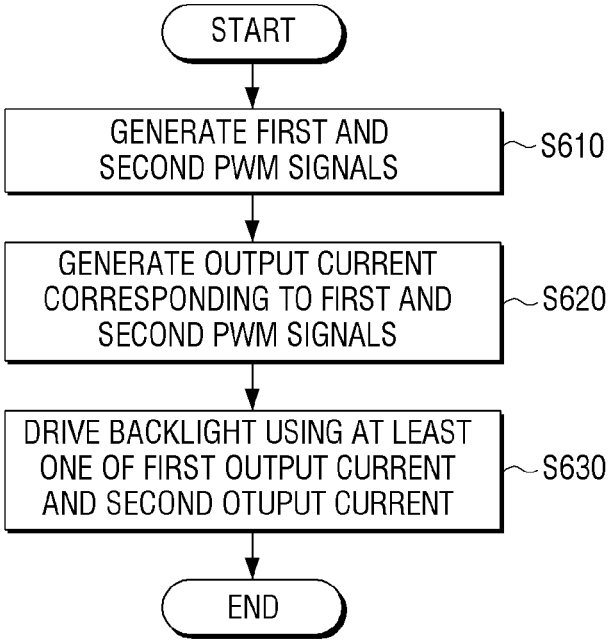
FIG. 6 is a flowchart of a method for driving a backlight in a display device according to an embodiment of the present disclosure.

FIG. 6 is a flowchart of a method for driving a backlight in a display device according to an embodiment of the present disclosure.

As illustrated in FIG. 6, the display device generates PWM signals for controlling on/off operation of driving current applied to a plurality of light emitting diodes constituting the backlight. Specifically, the display device generates a first PWM signal for controlling on/off operation of low current and a second PWM signal for controlling on/off operation of high current, which are applied to the plurality of light emitting diodes that constitute the backlight (S610).

Thereafter, the display device generates first output current using the first PWM signal through the low current driving circuit, and generates second output current using the second PWM signal through the high current driving circuit (S620). Thereafter, the display device drives the backlight including the plurality of light emitting diodes using at least one of the first output current generated through the low current driving circuit and the second output current generated through the high current driving circuit (S630).

Accordingly, the backlight may control the light emission and brightness of the plurality of light emitting diodes that constitute the backlight based on the output current that is applied from at least one of the low current driving circuit and the high current driving circuit.

On the other hand, the low current driving circuit that generates the first output current that is low current and the high current driving circuit that generates the second output current that is high current may be connected in parallel to each other. Further, it is preferable that the current per unit of time of the first output current that is low current generated from the low current driving circuit is lower than the current per unit of time of the second output current that is high current generated from the high current driving circuit.

Further, the sum of the current per unit of time of the first output current that is generated from the low current driving circuit and the current per unit of time of the second output current that is generated from the high current driving circuit may be the maximum allowable current. In this case, the current per unit of time of the second output current generated by the high current driver may have a size of (or amount) a multiple that is predetermined on the basis of the current per unit of time of the first output current generated by the low current driver.

For example, if the maximum current per unit of time that drives the backlight is 1 A, the current per unit of time of the first output current generated through the low current driver may be 0.2 A, and the current per unit of time of the second output current generated through the high current driver may be 0.8 A. Accordingly, the backlight may output an image with various brightness levels based on at least one of the first output current generated through the low current driver and the second output current generated through the high current driver.

While the present disclosure has been shown and described with reference to certain embodiments thereof, it will be understood by those skilled in the art that various changes in form and detail may be made therein without departing from the spirit and scope of the present disclosure, as defined by the appended claims.

What is claimed is:

1. A display device, comprising:

a signal generator configured to generate a first PWM (Pulse Width Modulation) signal and a second PWM signal;

a low current driver configured to generate a first output current using the first PIM signal;

a high current driver configured to generate a second output current greater than the first output current, using the second PWM signal; and a backlight configured to be driven by at least one of the first output current generated by the low current driver and the second output current generated by the high current driver, wherein, if a brightness of an image displayed through the backlight is equal to or lower than a predetermined brightness, the backlight is driven using only the first output current from among the first output current and the second output current, wherein the brightness of the image is divided into a plurality of levels, wherein, as a level increases in the plurality of levels, a width of the first PWM signal, which is used to generate the first output current is increased by a unit time, wherein the unit time is set according to a period of the first PWM signal, wherein a magnitude of current generated in the low current driver using the first PWM signal is gradually increased to the first output current, and wherein the unit time is longer than a time taken for the magnitude of current generated in the low current driver to reach the first output current.

2. The display device as claimed in claim 1, wherein a sum of the first output current and the second output current is a maximum allowable current of the backlight.

3. The display device as claimed in claim 1, wherein the low current driver and the high current driver are connected in parallel.

4. The display device as claimed in claim 1, wherein the second output current generated by the high current driver has an amount of a multiple predetermined on the basis of the first output current generated by the low current driver.

5. A method for driving a backlight of a display device, comprising:

generating a first PWM (Pulse Width Modulation) signal and a second PWM signal;

generating first output current from the first PWM signal using a low current driver, and generating second output current greater than the first output current, from the second PWM signal using a high current driver; and driving a backlight using at least one of the first output current and the second output current, wherein, if a brightness of an image displayed through the backlight is equal to or lower than a predetermined brightness, the backlight is driven by only the first output current generated by the low current driver, wherein the brightness of the image is divided into a plurality of levels according to brightness, wherein, as a level increases in the plurality of levels, width of the first PWM signal from which the first output current is generated, is increased by a unit time, wherein the unit time is set according to a period of the first PWM signal, wherein a magnitude of current generated using the low current driver from the first PWM signal is gradually increased to the first output current, and wherein the unit time is longer than a time taken for the magnitude of current generated using the low current driver to reach the first output current.

6. The method as claimed in claim 5, wherein a sum of the first output current and the second output current is a maximum allowable current.

7. The method as claimed in claim 5, wherein the low current driver and the high current driver are connected in parallel.

8. The method as claimed in claim 5, wherein the second output current generated by the high current driver has an amount of a multiple that is predetermined on the basis of the first output current generated by the low current driver.

* * * * *